United States Patent [19]

Won

[11] Patent Number: 4,511,084

[45] Date of Patent: Apr. 16, 1985

[54] TOP FEEDING LIQUID ATOMIZER

[76] Inventor: Vann Y. Won, 6697 Gloria Dr., Sacramento, Calif. 95831

[21] Appl. No.: 493,885

[22] Filed: May 12, 1983

[51] Int. Cl.[3] ..... B05B 3/02

[52] U.S. Cl. ..... 239/223

[58] Field of Search ..... 239/7, 214, 215, 216, 239/222.11, 223, 500, 224; 416/179, 181, 231 A; 159/4 S; 261/18 B, 84, 18 R

[56] References Cited

U.S. PATENT DOCUMENTS

| | | | |
|---|---|---|---|
| 1,823,844 | 9/1931 | Riley | 239/696 |
| 2,902,223 | 9/1959 | Nyrop | 239/223 |
| 3,144,209 | 8/1964 | Griffiths | 239/15 |
| 3,481,546 | 12/1969 | Nielsen | 159/4 S |
| 3,659,957 | 5/1972 | Yuen | 416/179 |
| 4,225,084 | 9/1980 | Bals | 239/223 |

OTHER PUBLICATIONS

Perry and Chilton, "Liquid-In-Gas Dispersions," *Chemical Engineer's Handbook,* 5th Ed., Sec. 18, pp. 61–63.

*Primary Examiner*—Andres Kashnikow
*Assistant Examiner*—James R. Moon, Jr.
*Attorney, Agent, or Firm*—Donald J. Singer; Jacob N. Erlich

[57] ABSTRACT

A top feeding atomizer having a body, and in which the body has an open ended cutout portion at one end thereof and a chamber at the other end thereof. A plurality of longitudinally extending openings interconnect the cutout portion with the chamber. In addition, a plurality of longitudinally extending passageways interconnect the chamber with the outside of the one end of said body. Continued rotation of the body, while liquid is fed into the open end cutout portion, forces the liquid through the interconnecting openings into the chamber and from the chamber up the passageways and out the passageways in a fine globular spray.

7 Claims, 5 Drawing Figures

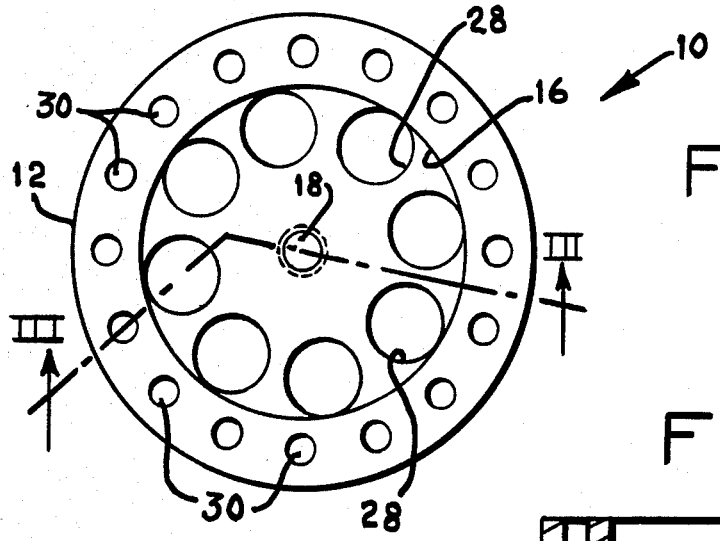
FIG. 2
FIG. 3
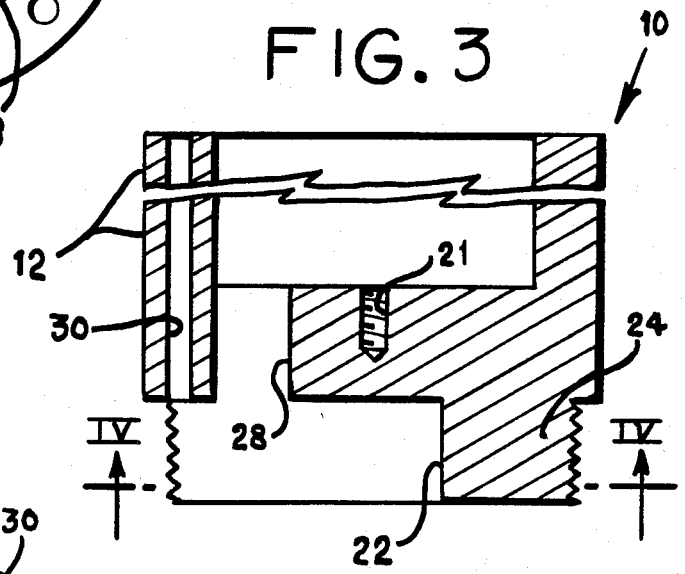
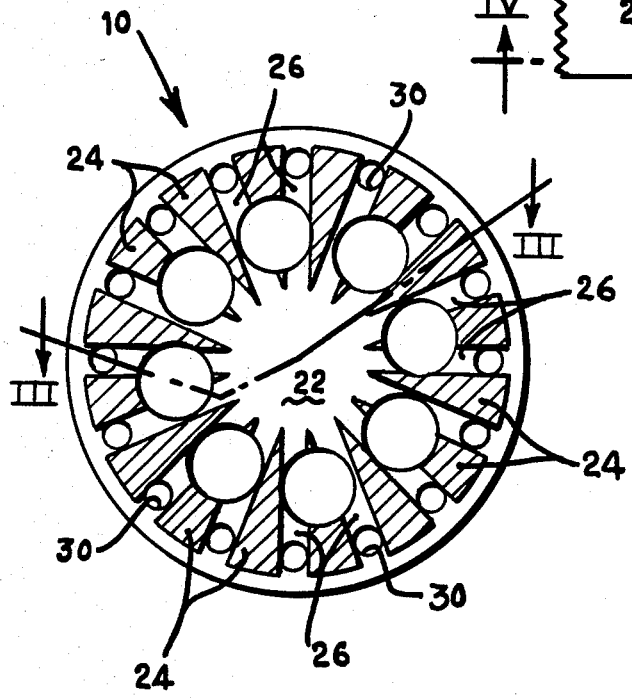
FIG. 4
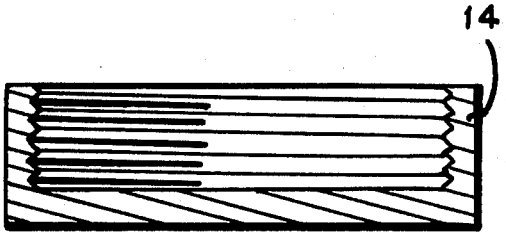
FIG. 5

TOP FEEDING LIQUID ATOMIZER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to an apparatus for atomizing and/or mixing liquids, and, more particularly, to a top feeding liquid atomizer.

Mixing devices take on a variety of forms, often being designed to perform a particular mixing operation. When it is merely desired to mix two or more liquids, which may contain solid materials, apparatus having rotating paddles or vanes or one or more propellers are often utilized. While such apparatus are generally suitable for normal mixing operations, they are not entirely satisfactory where it is necessary to obtain rapid and intimate contact between liquids.

One such device which is capable of rapidly atomizing and/or mixing liquids can be found in U.S. Pat. No. 3,659,957 issued on May 2, 1972 to this inventor, formerly known as Vann Yuen. Although the operation of the atomizer of U.S. Pat. No. 3,659,957 is acceptable in most instances, it lacks the ability to atomize and/or mix liquids which are fed in from the top by way of a liquid inlet tube. Consequently, it would be highly desirable to improve upon the liquid atomizer of U.S. Pat. No. 3,659,957 so as to make such an atomizer capable of accepting and readily atomizing and/or mixing top fed liquids.

SUMMARY OF THE INVENTION

The present invention overcomes the problems encountered in the past and as set forth in detail hereinabove by providing a liquid atomizer which is capable of receiving incoming liquid from the top and effectively atomizing and/or mixing such liquids.

The top feeding liquid atomizer of the present invention is made up of an elongated, preferably cylindrically-shaped body having a rotating means attached to one end thereof and a chamber having radially extending flow paths formed in the opposite end thereof. Situated in the top portion of the cylindrically-shaped body is a cutout portion, also preferably of cylindrical configuration. In communication with the cutout portion and also located in the body of the atomizer are a plurality of circumferentially spaced longitudinally extending openings which interconnect the cutout portion in the upper portion of the body with the chamber in the lower portion of the body. In addition, a plurality of longitudinally extending passageways are formed in the cylindrical body parallel to and adjacent the sides thereof. The passageways interconnect the chamber of the cylindrically-shaped body to the surrounding atmosphere situated adjacent the top of the body. The bottom of the body surrounding the chamber is completely closed but can be made in the form of a removable end cap.

During operation of the top feeding atomizer of the present invention, the cylindrically-shaped body is rotated by means of an externally located motor. During the rotation thereof liquid can be fed by an externally located tube into the cutout portion of the body. Centrifugal force acting upon the incoming liquid compresses the liquid into the plurality of openings leading to the chamber at the bottom of the body of the atomizer. As a result of continued spinning of the body, the liquid is then forced into the plurality of radially extending flow paths and then upward and outward through the longitudinal extending passageways into the atmosphere. As a result, a 360° outward spray of tiny droplets of liquid results much in the same manner as set forth in the above-mentioned U.S. Pat. No. 3,659,957.

The top feeding liquid atomizer of the present invention has many applications, such as, in the atomizing of mercury during the refining procedure of mercury in order to expose contaminants into cleaning agents to remove the contaminants that were involved in the mercury refining process. In addition, the top feeding liquid atomizer of the present invention can be utilized to atomize hydraulic fluid into a low pressure space, to atomize a mixture of liquids as a substitute to distillation, and, in addition, to perform such functions as mixing, agitating, blending, dispensing, pumping, spraying, evaporating, vaporizing, distilling, separating, extracting and emulsifying.

It is therefore an object of this invention to provide an atomizing and/or mixing device which is capable of receiving incoming liquid into the top thereof.

It is another object of this invention to provide a top feeding liquid atomizer to provide rapid and intimate contact between two or more incoming liquids.

It is another object of this invention to provide a top feeding liquid atomizer which is economical to produce and which utilizes conventional, currently available components that lend themselves to standard mass producing manufacturing techniques.

For a better understanding of the present invention, together with other and further objects thereof, reference is made to the following description, taken in conjunction with the accompanying drawing and its scope will be pointed out in the appended claims.

DETAILED DESCRIPTION OF THE DRAWING

FIG. 2 is a plan view of the top feeding liquid atomizer of this invention;

FIG. 3 is a side elevational view showing, in segmented fashion, the cylindrically-shaped body of the top feeding liquid atomizer of this invention taken along lines III—III of FIGS. 2 and 4;

FIG. 4 is a cross sectional view of the top feeding liquid atomizer of this invention taken along line IV—IV of FIG. 3; and FIG. 5 is a side elevational view of the end cap of top feeding liquid atomizer of this invention shown partly in cross section.

DETAILED DESCRIPTION OF THE PREFERRED EMBODIMENT

Figure 1:
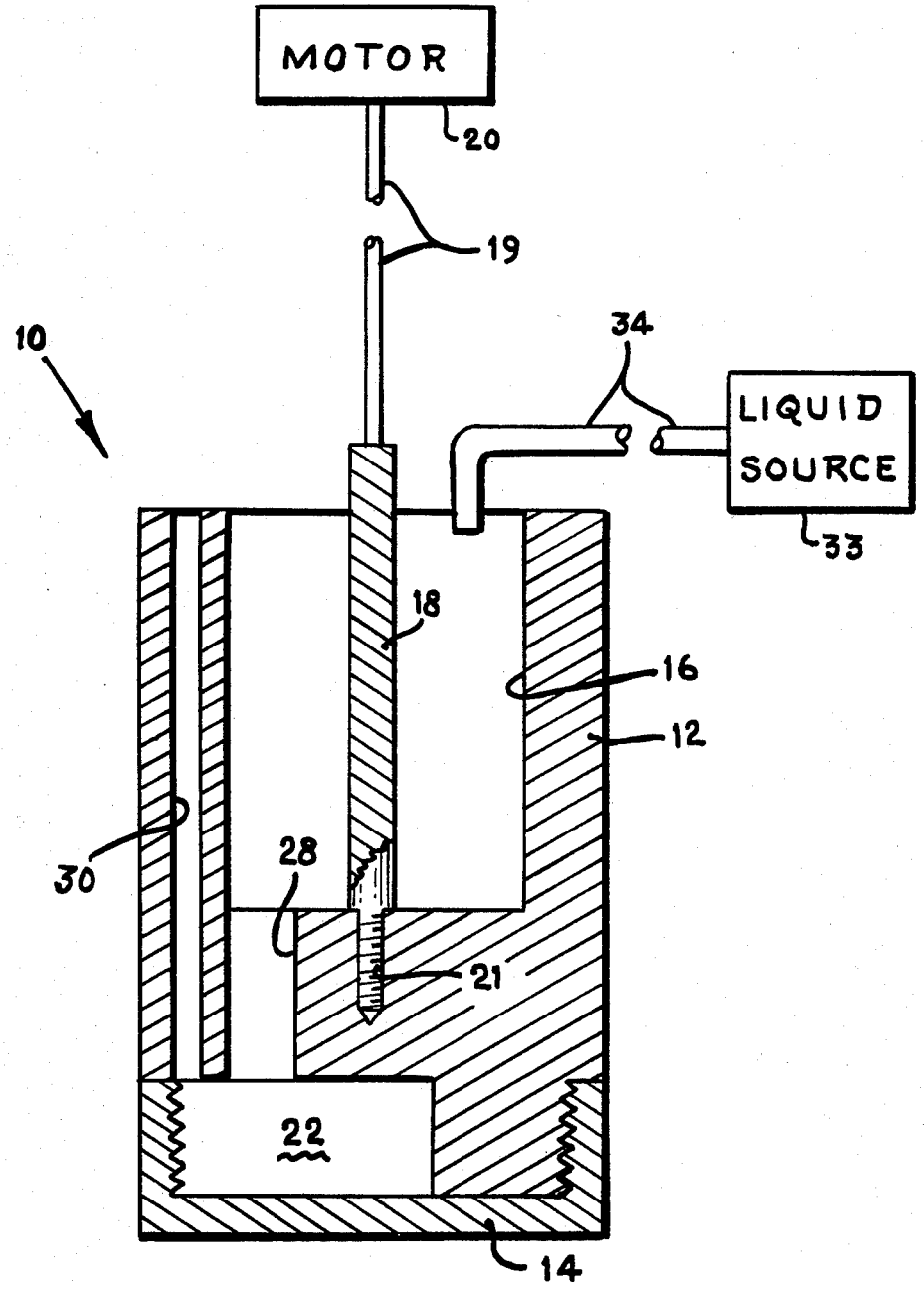
FIG. 1 is a side elevational view showing the top feeding liquid atomizer of this invention partly in cross section.

Reference is now made to FIG. 1 of the drawing which illustrates partly in cross-section the top feeding liquid atomizer 10 of the present invention. Atomizer 10 is made up of a preferably, cylindrically-shaped body 12 having an end cap 14 either removably secured thereto in the manner indicated in FIGS. 1, 3 and 5 of the drawing or, which may if desired, be fixedly secured to or formed an integral part of body 12.

More specifically, and as clearly illustrated in FIGS. 1 through 5 of the drawing, body 12 of the liquid atomizer 10 of the present invention has a preferably cylindrically-shaped cutout portion 16 situated in the top portion thereof so as to take on a cup-like configuration within body 12. Centrally located within body 12 is an upstanding shaft 18 which, when atomizer 10 is in use, is connected by any conventional connecting arrangement such rod 19 to a rotary driving device, such as electric motor 20. As seen in FIG. 1 of the drawing shaft 18 extends into the body 12 to which it is fixedly attached. This attachment can be accomplished by any suitable means, for example, by either applying an adhesive between the walls of an opening 21 located in body 12 and shaft 18 or by screwing shaft 18 into opening 21 which is threaded accordingly.

As clearly shown in FIGS. 1, 3 and 4 of the drawing a chamber 22 is formed at the bottom of body 12. Circumferentially interposed within chamber 22 of body 12 are wedge-shaped ribs 24 of body 12 so as to form a plurality of radially extending flow paths or channels 26. The end cap 14 as shown in FIG. 5 as well as FIG. 1 of the drawing can be removably secured to body 12 adjacent the wedge-shaped portions 24 so as to completely enclose the bottom of chamber 22. Although, for reasons to be set forth in detail hereinbelow, the bottom of body 12 is made up of a removable end cap 14, end cap 14 may also be formed as an integral part of body 12 without having the removability feature associated therewith.

Still referring to FIGS. 1 through 4 of the drawing, the cutout portion 16 in body 12 is in communication with chamber 22 by means of a plurality of circumferentially spaced apart longitudinally extending openings 28. These openings 28 allow for the interconnection between cutout portion 16 and chamber 22. In addition, a plurality of spaced apart longitudinally extending passageways 30 interconnect chamber 22 to the surrounding atmosphere adjacent the top surface of body 12.

Passageways 30 extend through body 12 between the top of body 12 and chamber 22. The longitudinal or vertical axes of passageways 30 are substantially parallel to one another as well as to the sides of the cylindrically-shaped body 12. Each of the wedged-shaped ribs 24 intercept chamber 22 at a location between pairs of adjacent passageways 30.

By providing the interconnection between chamber 22 and the cutout portion 16 in the manner provided by this invention and as shown in the drawing, it is possible to feed an incoming liquid provided by a suitable liquid source 33 through an inlet tube 34 as shown in FIG. 1 of the drawing into the top surface or top portion of body 12. Inlet tube 34 is positioned within or adjacent cutout portion 16 so as to direct liquid into the cutout portion 16. From there, by means of the plurality of openings 28, liquid emanating from tube 34, during the spinning of body 12, is forced into chamber 22 and from there forced out of chamber 22 through passageways 30.

The top feeding liquid atomizer 10 of this invention can be fabricated from any suitable material including metals and plastics. However, it is usually preferred to utilize a plastic material such as an epoxy resin, polyethylene, polypropylene, polyurethane, and the like. Atomizer 10 may be manufactured by a molding technique or by a machining operation or by a combination of the two methods. As shown in FIG. 1 of the drawing, after performing the required machining operations, the bottom cap 14 can be attached to the body 12.

MODE OF OPERATION

In the operation, top feeding liquid atomizer 10 of this invention has shaft 18 attached to electric motor 20. By appropriate regulation of motor 20, body 12 of atomizer 10 can be rotated, preferably at speeds of between 1000 to 2000 rpms while liquid is fed from inlet tube 34 into the cutout portion 16 of body 12. The centrifugal force created as body 12 rotates, compresses the incoming liquid into chamber 22 by forcing the liquid through the plurality of openings 28 which interconnect cutout portion 16 with chamber 22. Continual rotation of body 12 causes the liquid to be impelled outwardly through flow channels 26 toward the side walls of chamber 22 through the action of ribs 24 on the liquid as well as the centrifugal force imparted on the liquid by the rotation of body 12. The liquid is thereby forced into the passageways 30 and thence upwardly into the surrounding atmosphere. The liquid leaves the passageways 30 through the top thereof in a fine globular spray. This spray is directed at 360° outward from the top of body 12. The rapidity of the mixing operation depends at least to some degree upon the speed of rotation of cylindrical body 12. In general, the greater the speed of rotation, the more rapid the mixing of the dispersed liquid can be accomplished.

Furthermore, by replacing end cap 14 with a cap having an opening therein and by plugging cutout portion 16, it is possible to convert the present invention into a bottom feeding atomizer similar to the type set forth in the above-mentioned U.S. Pat. No. 3,659,957. Consequently, the present invention has substantially increased its utilization in atomizing and/or mixing applications.

It should be understood that the sizing of the atomizer 10, that is, the dimensions of cutout portion 16, opening 28, passageways 30, and rib members 24 as well as the volume of chamber 22, will have an influence on the efficiency of the atomizer 10 in a mixing operation. By appropriately altering these dimensions it is possible to design a particular sized apparatus for its particular or specific application.

Although this invention has been described with reference to a particular embodiment, it will be understood that this invention is also capable of further and other embodiments within the spirit and scope of the appended claims.

I claim:

1. A top feeding liquid atomizer comprising:

an elongated body, said body having a top first end and closed second end;

a cutout portion situated adjacent said first end of said body, said cutout portion having an open top;

a chamber situated adjacent said second end of said body, said chamber having a plurality of spaced apart, radially extending, wedge-shaped ribs therein, with the spaces between adjacent pairs of said wedge-shaped ribs defining a plurality of radially extending flow channels, respectively;

means within said body for interconnecting said cutout portion with said chamber;

a plurality of longitudinally extending, elongated passageways formed in said body and having openings positioned adjacent the periphery of the top of said first end of said body, said passageways extending from the top of said first end of said body into said chamber such that each of said passageways is situated within each of said flow channels, respectively, and each of said wedge-shaped ribs intercept said chamber at a location between adjacent pairs of said passageways, said passageways having their longitudinal axes substantially parallel to the longitudinal axis of said body; and means operably connected to said body for rotating said body at a preselected speed;

whereby continual rotation of said body, while liquid is fed into said open top of said cutout portion forces said liquid through said interconnecting means into said chamber, through said flow channels, and up said passageways into the surrounding atmosphere adjacent the top of said first end of said body in the form of a fine globular spray.

2. A top feeding liquid atomizer as defined in claim 1 wherein said interconnecting means comprises a plurality of spaced apart, longitudinally extending openings.

3. A top feeding liquid atomizer as defined in claim 2 further comprising a closed end cap removably secured to said body and forming the bottom of said chamber.

4. A top feeding liquid atomizer as defined in claim 3 further comprising means for feeding said liquid into said open top of said cutout portion.

5. A top feeding liquid atomizer as defined in claim 4 wherein said means for rotating said body comprises an upstanding element is secured at one end to the bottom surface of said cutout portion and at the other end to a motor.

6. A top feeding liquid atomizer as defined in claim 5 wherein said upstanding element is centrally located within said cutout portion.

7. A top feeding liquid atomizer as defined in claim 6 wherein said liquid feeding means comprises a tube extending into said open top of said cutout portion.

* * * * *